US006971180B2

(12) United States Patent
Yocum

(10) Patent No.: US 6,971,180 B2
(45) Date of Patent: Dec. 6, 2005

(54) PAINT CAN CHANNEL PERFORATING APPARATUS

(76) Inventor: Chris Yocum, 9 Lincoln Way, Sparks, NV (US) 89431

( * ) Notice: Subject to any disclaimer, the term of this patent is extended or adjusted under 35 U.S.C. 154(b) by 155 days.

(21) Appl. No.: 10/154,098

(22) Filed: May 23, 2002

(65) Prior Publication Data

US 2003/0217631 A1 Nov. 27, 2003

(51) Int. Cl.[7] ..... B67B 7/46; B67B 7/48

(52) U.S. Cl. ..... 30/402; 30/443; 30/445; 30/446; 30/447; 30/366

(58) Field of Search ..... 83/946, 745, 30, 83/660; 30/402, 414, 358, 366, 443, 446, 30/445, 447; 220/751, 699, 733, 345.4, 801; D8/33, 3; D32/54

(56) References Cited

U.S. PATENT DOCUMENTS

| | | | | | |
|---|---|---|---|---|---|
| 107,061 | A | * | 9/1870 | Kaufman | 30/445 |
| 580,916 | A | * | 4/1897 | Westerfield | 30/446 |
| 1,024,403 | A | * | 4/1912 | Hill | 81/3.48 |
| 1,509,867 | A | * | 9/1924 | Gordy | 30/446 |
| 1,789,729 | A | * | 1/1931 | Coyle | 30/445 |
| 1,923,779 | A | * | 8/1933 | Dye | 30/446 |
| 1,937,975 | A | * | 12/1933 | Mead | 30/446 |
| 2,084,084 | A | * | 6/1937 | Greer | 220/798 |
| 2,200,029 | A | * | 5/1940 | Kulling | 30/446 |
| 2,249,631 | A | * | 7/1941 | Kershenstein | 30/446 |
| 2,313,059 | A | | 3/1943 | Freeman | |
| 2,321,492 | A | | 6/1943 | Kinney | |
| 2,349,128 | A | * | 5/1944 | Akers | 30/446 |
| 2,359,883 | A | * | 10/1944 | Swanson | 30/446 |
| 2,376,756 | A | * | 5/1945 | Bye | 30/446 |
| 2,569,123 | A | * | 9/1951 | Anderson | 30/447 |
| 2,709,022 | A | * | 5/1955 | Fatke | 220/325 |
| 2,712,176 | A | * | 7/1955 | Miller et al. | 30/445 |
| 2,721,380 | A | * | 10/1955 | Gagnon | 30/447 |
| 2,784,488 | A | * | 3/1957 | Olson et al. | 30/446 |
| 2,873,881 | A | | 2/1959 | Nichols | |
| 2,885,108 | A | | 5/1959 | Donoghue | |
| 3,172,478 | A | * | 3/1965 | Giclas | 220/278 |
| 3,298,100 | A | * | 1/1967 | Walker et al. | 30/443 |
| 3,786,564 | A | * | 1/1974 | Acheson | 30/310 |
| 4,182,151 | A | * | 1/1980 | Pedersen | 72/325 |
| 4,186,485 | A | * | 2/1980 | Bainton et al. | 30/443 |
| 4,190,957 | A | * | 3/1980 | Hasegawa et al. | 30/411 |
| 4,674,144 | A | | 6/1987 | Palmeri | |
| 4,911,319 | A | | 3/1990 | DeJean | |
| 4,924,768 | A | | 5/1990 | Jay | |

(Continued)

*Primary Examiner*—Allan N. Shoap
*Assistant Examiner*—Jason Prone
(74) *Attorney, Agent, or Firm*—Marshall, Gerstein & Borun LLP

(57) ABSTRACT

A paint can channel perforating apparatus includes a perforating member, a stiffening brace and a plurality of perforating bits. The perforating bits are arranged normal to the plane defined by the perforating member. A protective housing may be adapted to enclose the perforating member and the rim of a paint can. The protective housing includes at least one cross member arranged parallel to the stiffening brace and a plurality of guides sized to accept and direct the stiffening brace linearly. A shaft may be fixedly attached to the stiffening brace and slideable relative to an orifice defined within one of at least one of the cross members. Further a spring may be positioned around the shaft and between a handle and the cross member to return the perforating bits to a rest position after the channel has been pierced by the perforating bits.

13 Claims, 4 Drawing Sheets

U.S. PATENT DOCUMENTS 4,928,846 A * 5/1990 Murrin, Jr. ..... 220/797
5,123,565 A 6/1992 Majewski
5,203,087 A * 4/1993 Richard ..... 30/446
5,535,657 A * 7/1996 Bystrom ..... 83/745
5,752,619 A 5/1998 Fulton
5,946,809 A * 9/1999 Bright ..... 30/358
5,967,363 A 10/1999 Allen
6,237,227 B1 * 5/2001 Pojunas, Sr. ..... 30/366
6,386,385 B1 * 5/2002 Amanat et al. ..... 220/258.4
2002/0030058 A1 * 3/2002 Bothwell ..... 220/700

* cited by examiner

PAINT CAN CHANNEL PERFORATING APPARATUS

BACKGROUND

When applying paint to a surface, regardless of the project size, excess paint often accumulates in a groove or a channel formed into the rim of the paint can. The simple actions of wiping a sodden brush against the rim of the can or pouring paint into another vessel may result in copious amounts of excess paint gathering in the channel. Even preparing a fresh can of paint for use, by stirring the contents to insure consistency and color, may result in unwanted paint accumulating in the channel. The unwanted paint may dry and clog the channel making it difficult to create an airtight seal when it comes time to reattach the paint can lid after a project. Typical paint can lids are flat disks formed with a locking ridge which is intended to cooperate and interlock with the channel formed into the rim. To create an airtight seal, and thereby protect any unused paint from exposure to air, the locking ridge may be positioned adjacent to the mating channel and a downward force may be applied to the lid. The locking ridge may be forced into the channel, creating a pressure seal, and the excess paint is displaced outward causing it to run down the side of the can, splatter onto the nearby environs and generally creating a mess.

SUMMARY

An embodiment of a paint can channel perforating apparatus may include a toroidal member having a stiffening brace affixed to opposing edges of the toroidal member. Further, a plurality of perforating bits may be affixed to the toroidal member and aligned normal to the plane defined by the toroidal member. A housing may be adapted to enclose the toroidal member and the rim of a paint can. The housing may include at least one cross member arranged substantially parallel to the stiffening brace. The housing may further include a plurality of linear guides sized to accept and direct the stiffening brace along a desired path. A shaft may be fixedly attached to the stiffening brace and slideable inside an orifice defined within one of the cross members. Further, a reactive member or spring may be positioned around the shaft and contained between a retaining cap and the cross member. A force may be applied to the retaining cap, when the perforating apparatus is disposed adjacent to the rim of the paint can, that causes the cross member, toroidal member and the plurality of perforating bits to translate downward. This downward translation brings the cross member, toroidal member and the perforating bits into contact with the channel located around the rim of the paint can and form a hole at each perforation point. Upon cessation of the force, the spring produces an opposing force, perpendicular to the channel in this example, which causes the plurality of perforating bits to return to their retracted position.

DETAILED DESCRIPTION OF THE EMBODIMENT

Figure 1:
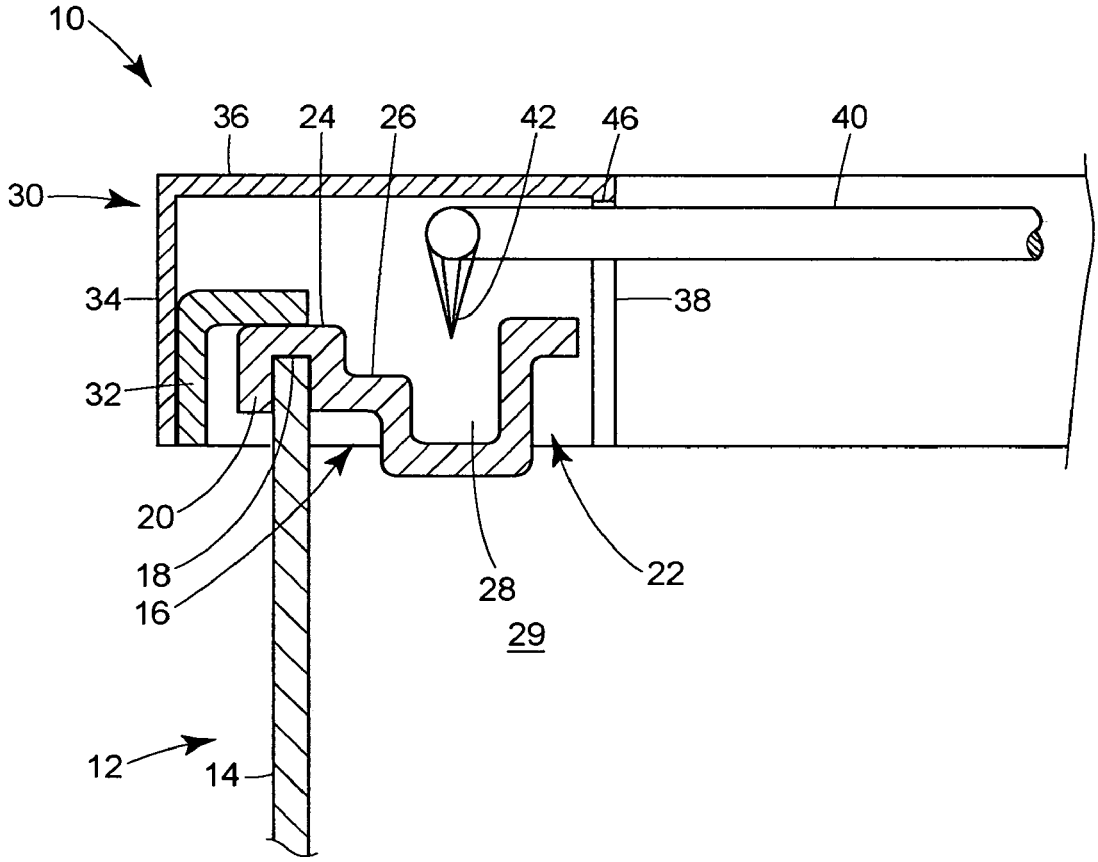
FIG. 1 is an enlarged sectional view of a paint can perforating apparatus positioned on a paint can channel.

Illustrated in FIG. 1, is a perforating apparatus, generally represented by the numeral 10, disposed upon a standard paint can 12. The paint can 12 may include a side wall 14 and a rim 16. The rim 16 may be fixedly attached to a top edge 18 of the side wall 14 using an integral clamp 20. The rim 16 may further include a gauge surface 24 representing the top-most edge of the side wall 14. The paint can 12 may have a lip 22, which may extend inward relative to the side wall 14, and may include a hard stop 26 and a channel 28. The hard stop 26 acts to prevent the over-insertion of the lid (not shown) during the operation of resealing the paint can 12. The channel 28 may be engaged by a corresponding locking ridge on the lid (not shown) to create a tight seal between the lid (not shown) and the lip 22, thereby protecting the paint 29 from exposure to air.

The perforating apparatus 10 may include an enclosure 30. The enclosure 30 may be aligned relative to the side wall 14 and the gauge surface 24 by a guide 32. The enclosure 30 may further include an outer wall 34, a top wall 36 and an inner wall 38. The guide 32 may be fixedly attached to the outer wall 34, as shown, or may be integrally formed as part of the outer wall 34. The guide 32 insures that the perforating apparatus 10 is correctly positioned relative to the rim 16 and the channel 28 of the paint can 12. The perforating apparatus 10 may still further include a piercing member 40, depicted as annular or ring shaped in this example, and a plurality of piercing bits 42 affixed normal to the piercing member 40.

Figure 2:
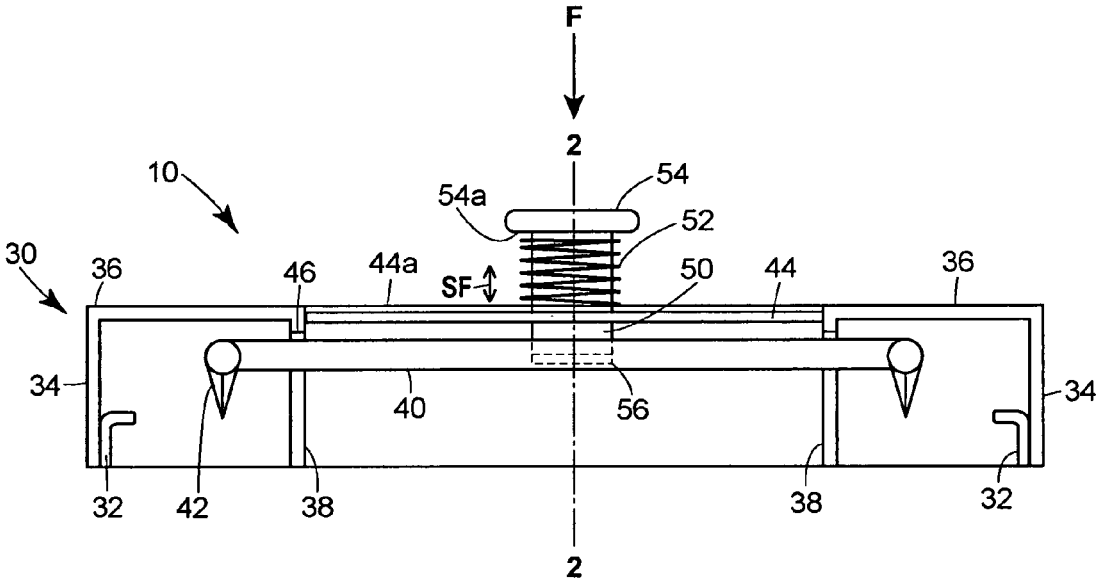
FIG. 2 is a sectional view of the paint can perforating apparatus.

Illustrated in FIG. 2 is a sectional view of the perforating apparatus 10 away from the paint can 12. The perforating apparatus 10 may have a U-shaped housing, which may be symmetrical around the centerline 2—2, formed by the interaction of the outer wall 34, the top wall 36 and the inner wall 38. The inner wall 38 may be fixedly attached in at least one location to a support member 44 which increases the strength and structural integrity of the enclosure 30. The inner wall 38 further may include a plurality of vertical guides 46, illustrated in FIGS. 2 and 3.

Figure 3:
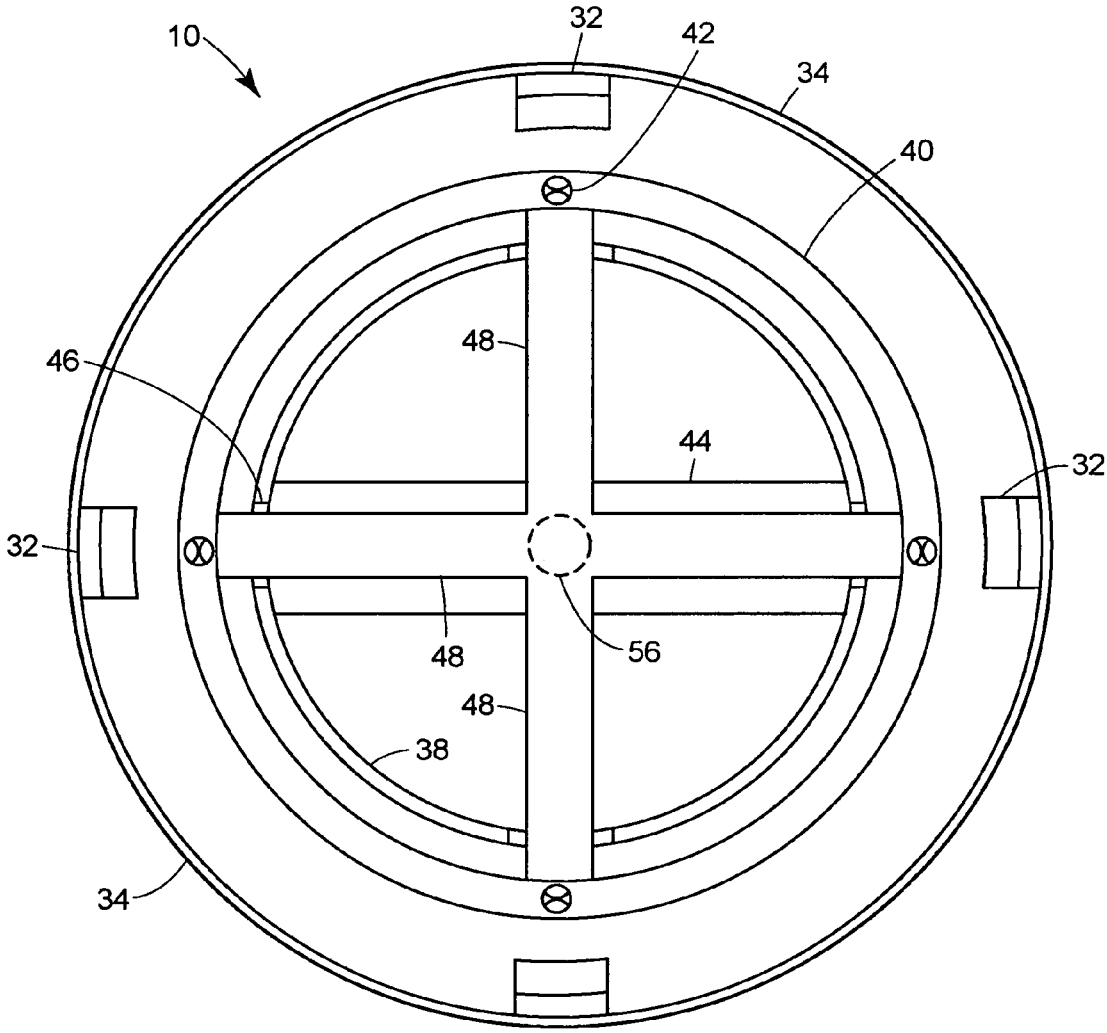
FIG. 3 is a bottom view of the paint can piercing apparatus.

The piercing member 40 may be attached to a plurality of cross members 48, as illustrated in detail in FIG. 3. The cross member 48, in turn, may be connected to a drive shaft 50 which extends perpendicularly from the plane of the piercing member 40. The drive shaft 50 passes through an orifice (reference numeral "58" in FIG. 4) located within the support member 44. A spring 52 may be positioned adjacent to the drive shaft 50 and may be contained between the support member 44 and a handle 54. The handle 54 may be attached to the distal end of the drive shaft 50 in any known manner, such as threaded on, welded and/or pinned.

When the perforating apparatus 10 is not in use, the spring 52 supports the piercing member 40 in a retracted or up position, as illustrated in FIG. 2. In the retracted position the spring 52 exerts a spring force SF against a bottom surface 54*a* of the handle 54 and a top surface 44*a* of the support member 44. Ideally, the resistance provided by the spring force SF is great enough to retain the piercing member 40, the piercing bits 42, and the cross member 48 in the retracted or up position.

In operation, a force F, in excess of the spring force SF, may be applied to the handle 54. The force F is communicated through the handle 54 and the drive shaft 50 to the cross member 48. The cross member 48 may be confined within the linear guides 46 and operatively connected to the piercing member 40 and the piercing bits 42. The linear guides 46 resist any torsion or rotational forces transmitted to the cross member 48 to insure that the attached the piercing member 40 and the piercing bits 42 travel in a substantially linear path when the cross member 48 is subjected to the force F. The linear path traveled by the piercing member 40 between the retracted position and a perforating position brings the attached piercing bits 42 into contact with the channel 28, when the perforating apparatus 10 is properly aligned on the rim 16 of the paint can 12.

FIG. 3 illustrates the bottom view of a perforating apparatus 10. The cross members 48 are fixedly attached to the piercing member 40 and contained by the linear guides 46. The hidden line 56 represents the base of the drive shaft 50 where it is fixedly attached to the cross members 48. In one embodiment, the guide 32 is represented as multiple pieces located around the outer wall 34; it should be noted that the guide may be formed into the outer wall 34 to create a continuous surface around the circumference of the perforating apparatus 10.

Figure 4:
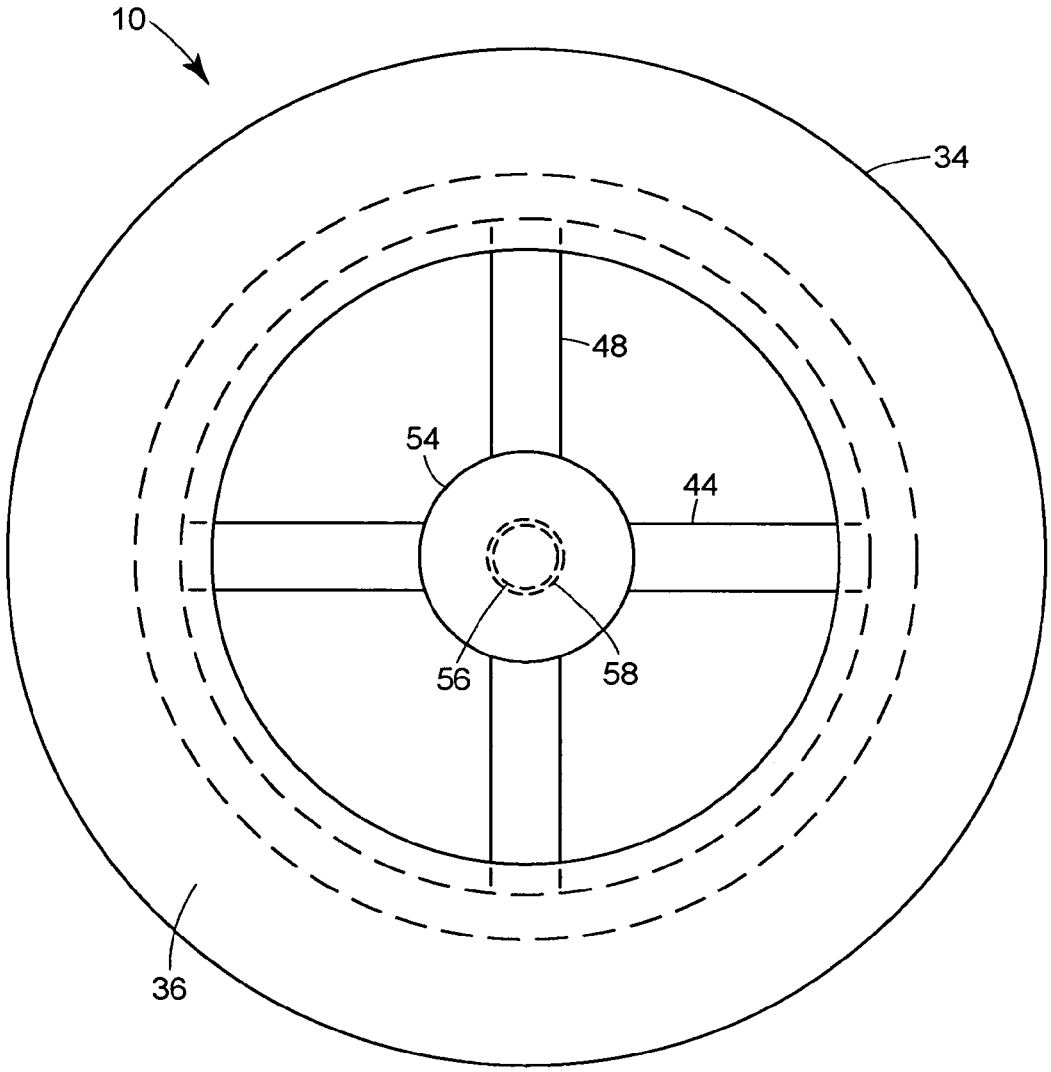
FIG. 4 is a top view of the paint can perforating apparatus.

FIG. 4 illustrates a top view of a perforating apparatus 20. The handle 54 is disposed upon the distal end of the drive shaft 50, an opposite end of which is represented by the hidden line 56. Further, the hidden line 58 represents the orifice located within the support member 44.

In operation, the user may place the perforating apparatus 10 upon the rim 16 of a standard paint can 12. The final alignment of the perforating apparatus 10 may be facilitated by a guide 32 attached to the enclosure 30 and sized to engage the rim 16. The guide 32 acts to align the piercing member 40 and the piercing bits 42 above the channel 28. The user, by placing one hand on the top surface 36 of the enclosure 30, may insure that the enclosure 30 remains in contact with the rim 16 during operation. Further, the perforating apparatus 10 may be secured to the paint can 12 using an additional attachment mechanism, such as a strap or a clamp (not shown), which insures that the enclosure 30 remains in contact with the rim 16.

Further, the user may apply a force F to the handle 54 to overcome the spring force SF the spring 52, which is acting against the top surface 44*a* of the support member 44 and the bottom surface 54*a* of the handle 54, and shift the drive shaft 50 linearly. As the spring 52 compresses, the drive shaft 50 and attached cross member 48 shift downward within the linear guides 46. The cross member 48 is operatively connected to the aligned piercing member 40 and the attached piercing bits 42. The motion of the cross member 48 within the vertical guides 46 drives the piercing bits 42 into and through the channel 28 to create a plurality of holes through which paint may drain.

Upon removal of the force F from the handle 54, the spring 52 begins to release its stored energy. The spring 52 contained by the fixed top surface 44*a* of the support member 44, acts against the movable bottom surface 54*a* of the handle 54. The release of the stored energy within the spring 52, in turn, causes the connected piercing bits 42, piercing member 40, and the support member 44 to return to their original retracted position.

Further, the force F may be generated by an automated mechanism such as a mechanical, hydraulic or pneumatic press. The handle 54 may be adapted to accept the drive piston incorporated into such a mechanism. By positioning the paint can 12 beneath automated assembly the spring 52 and the connected piercing bits 42, piercing member 40 and support member may be driven into and through the channel 28 to create the desired drainage holes. By reversing the mechanism the aforementioned components may be withdrawn from the channel allowing multiple paint cans 12 to be pierced in a short timeframe.

While the present invention has been described with reference to a specific embodiment which is intended to be illustrative only and not limiting of the invention, it will be apparent to those of ordinary skill in the art that changes, additions or deletions may be made to the disclosed embodiment without departing from the spirit and scope of the invention.

What is claimed:

1. A paint can channel perforating apparatus comprising:

an enclosure adapted to engage a top edge of a paint can, wherein the enclosure includes:

a cylindrical inner wall;

a cylindrical outer wall; and a top wall connected to a top edge of the cylindrical inner wall and to a top edge of the cylindrical outer wall, wherein the inner wall and the outer wall are sized to enclose the top edge of the paint can when the enclosure is disposed thereon;

an annular piercing member operatively coupled to the enclosure such that the piercing member is movable relative to the enclosure between a non-piercing position and a piercing position; and at least one piercing bit connected to the piercing member;

wherein the at least one piercing bit is disposed on the piercing member such that the at least one piercing bit punctures a channel of the paint can when the enclosure is disposed on the top edge of the paint can and the piercing member moves from the non-piercing position to the piercing position.

2. A paint can channel perforating apparatus comprising:

an enclosure including a cylindrical inner wall, a cylindrical outer wall, and a top wall connected to a top edge of the cylindrical inner wall and to a top edge of the cylindrical outer wall, wherein the inner wall and the outer wall are sized to enclose the top edge of the paint can when the enclosure is disposed thereon;

an annular piercing member having at least one cross member fixedly attached thereto and operatively coupled to the enclosure such that the piercing member is movable between a non-piercing position and a piercing position; and at least one piercing bit connected to the piercing member;

wherein the at least one piercing bit is disposed on the piercing member such that the at least one piercing bit punctures a channel of the paint can when the enclosure is disposed on the top edge of the paint can and the piercing member moves from the non-piercing position to the piercing position.

3. The perforating apparatus of claim 1 wherein the cylindrical inner wall includes a surface extending upwardly from a bottom edge of the cylindrical inner wall and defining a vertical guide, the vertical guide configured to receive the at least one cross member and to permit the piercing member to move between the non-piercing position and the piercing position.

4. The perforating apparatus of claim 3 further comprising a drive shaft having a first end fixedly attached to a drive handle and a second end fixedly attached to the at least one cross member.

5. The perforating apparatus of claim 4 further comprising a spring engaging the drive handle and enclosure to bias the piercing member to the non-piercing position.

6. A perforating apparatus comprising:

an enclosure having a cylindrical outer wall, a cylindrical inner wall, and a top wall connected to a top edge of the outer wall and a top edge of the inner wall, wherein the enclosure is sized to enclose a paint can rim between the inner wall and the outer wall when the enclosure is disposed thereon;

an annular piercing member;

a cross member fixedly attached to the annular piercing member;

a drive shaft fixedly attached to the cross member and moveably coupled to the enclosure to move the piercing member between a non-piercing position and a piercing position; and at least one piercing bit fixedly attached to the piercing member and adapted to puncture a channel of the paint can rim when the enclosure is disposed on the paint can rim and the piercing member moves from the non-piercing position to the piercing position.

7. The perforating apparatus of claim 6 wherein the enclosure is constructed from a material selected from the group consisting of plastic and metal.

8. The perforating apparatus of claim 6 further comprising a spring biasing the piercing member to non-piercing position.

9. The perforating apparatus of claim 6, wherein the cylindrical inner wall includes a surface extending upwardly from a bottom edge of the cylindrical inner wall and defining a vertical guide configured to receive the cross member and to allow movement of the piercing member between the non-piercing position and the piercing position.

10. The perforating apparatus of claim 6, wherein the plurality of piercing bits are constructed from a material selected from the group consisting of carbide and tool steel.

11. The perforating apparatus of claim 6, wherein the piercing member moves in a linear path between the non-piercing position and the piercing position.

12. The perforating apparatus of claim 6 wherein the enclosure includes a support member connected thereto, the support member having an orifice sized to receive the drive shaft.

13. The perforating apparatus of claim 12 wherein the drive shaft includes a handle disposed distal to the piercing member.

* * * * *